US006018880A

United States Patent [19]

Wiggins

[11] Patent Number: 6,018,880

[45] **Date of Patent: *Feb. 1, 2000**

[54] STRAIGHT EDGE GUIDE FOR CUTTING MATERIALS

[76] Inventor: David C. Wiggins, 823 Robert E. Lee Blvd., Charleston, S.C. 29412

[ * ] Notice: Under 35 U.S.C. 154(b), the term of this patent shall be extended for 602 days.

[21] Appl. No.: 08/599,934

[22] Filed: Feb. 14, 1996

[51] Int. Cl.[7] ..... B43L 7/00

[52] U.S. Cl. ..... 33/474; 33/480; 33/483

[58] Field of Search ..... 33/403, 415, 418, 33/420, 427, 428, 429, 474, 479, 480, 482; 10/61, 64, 65, 71

[56] References Cited

U.S. PATENT DOCUMENTS

| | | | |
|---|---|---|---|
| 743,119 | 11/1903 | Watson, Jr. . | |
| 784,079 | 3/1905 | Stempel | 33/429 |
| 827,989 | 8/1906 | Noble | 33/474 |
| 844,205 | 2/1907 | Sollers | 33/499 |
| 1,145,531 | 7/1915 | Ware | 33/482 |
| 1,255,429 | 2/1918 | Killion | 33/429 |
| 2,080,620 | 5/1937 | Martin | 33/474 |
| 2,593,914 | 4/1952 | Palitto | D10/65 |
| 2,642,674 | 6/1953 | Schell, Jr. . | |
| 3,087,250 | 4/1963 | Blue . | |
| 3,327,360 | 6/1967 | Nichols | 33/429 |
| 4,852,259 | 8/1989 | Manserra | 30/289 |
| 4,926,564 | 5/1990 | Loggins | 33/474 |
| 4,989,335 | 2/1991 | Day . | |
| 5,191,716 | 3/1993 | Anderson | 33/483 |
| 5,201,783 | 4/1993 | Peters | 33/474 |
| 5,353,508 | 10/1994 | Baker . | |

FOREIGN PATENT DOCUMENTS

| | | | |
|---|---|---|---|
| 20174 | 5/1905 | Austria | 33/429 |
| 191166 | 8/1957 | Austria | 33/474 |
| 502399 | 7/1930 | Germany | 33/429 |

OTHER PUBLICATIONS

P. 7, Crain Floor Covering Tools Catalogue No. 122C, no date.

*Primary Examiner*—Andrew Hirshfeld
*Attorney, Agent, or Firm*—B. Craig Killough

[57] ABSTRACT

A straight edge guide having a straight edge formed along a first elongated planar member. An elevated handle is provided to hold the device in place which positions a user's hand above a blade which traverses the elongated planar member, and which transfers a user's weight through the handle as the user is in the kneeling position to hold one end of the guide in place, while the opposite end of the guide is held in place by the user's knee. An outrigger is provided which provides further friction to hold the device in place.

1 Claim, 4 Drawing Sheets

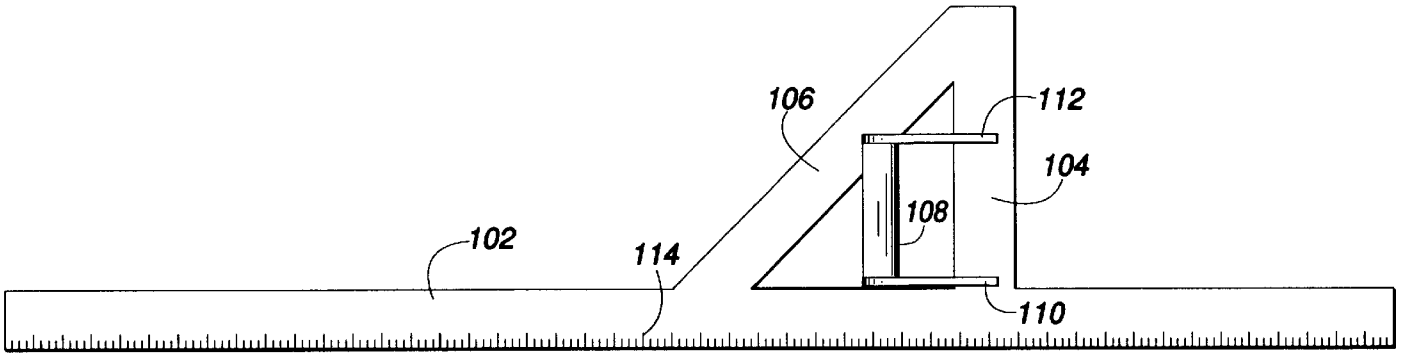
FIG. 7
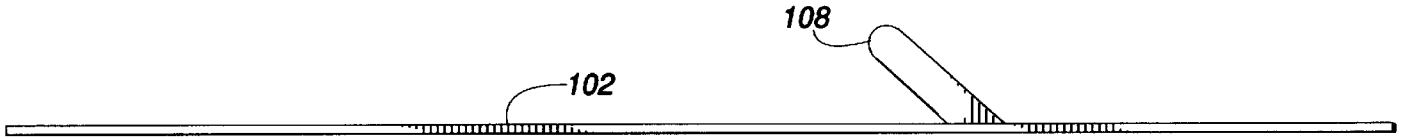
FIG. 8
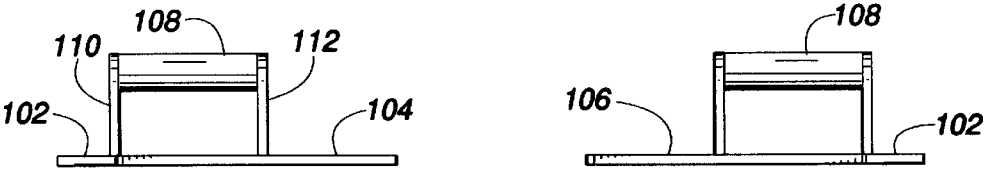
FIG. 9
FIG. 10
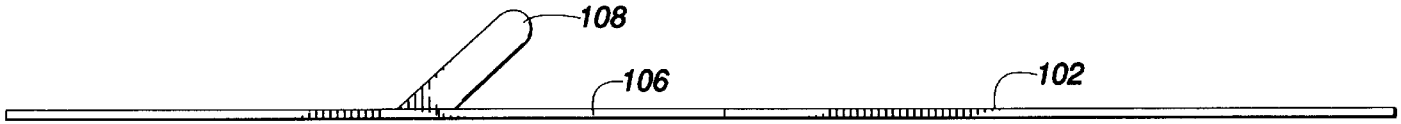
FIG. 11

STRAIGHT EDGE GUIDE FOR CUTTING MATERIALS

FIELD OF THE INVENTION

This invention relates to straight edge devices generally, and is more specifically directed to a straight edge which may be used for cutting sections of sheet-like materials which are commonly transported in rolls, such as floor covering materials.

BACKGROUND OF THE INVENTION

Certain materials are produced in large sheets having substantial lengths. Portions of these materials are separated for use or installation by cutting smaller pieces from the larger piece.

An example of such a material is a floor covering. Floor coverings are commonly manufactured from materials such as vinyl. Floor coverings are produced in sheets and are formed in a roll for ease of transportion.

A large piece of floor covering may be grossly separated from the larger roll. The piece which is grossly separated approximates the size which is needed to cover a particular floor in a house or building.

However, as the floor covering is installed, it is necessary to accurately shape the floor covering to the floor to be covered. The floor covering is positioned over the floor to be covered, and an installer cuts the floor covering to the required dimensions. The final shape of the floor covering as it is installed will typically be of varied shapes to account for numerous corners within a room, such as a kitchen. The floor covering must be precisely cut so as to adequately and properly cover the floor, and mistakes in cutting can result in large and valuable pieces of floor covering being rendered unusable.

In the prior art, straight edge devices are used to assist in cutting materials formed in sheets. Straight edges in common use are typically simple elongated planes. These elongated planes may have a safety guard formed along the length of the straight edge, or the straight edge may be flexible in nature. The straight edges may also provide 90° angles or "squares" for forming right angles in the material to be cut. Graduated markings are sometimes provided on the straight edges for measuring.

However, in the prior art, these straight edges are difficult to handle. No means is provided to both steady the straight edge along its length and to hold it securely against the material to be cut, while a blade is drawn across the material to cut the material. In the prior art, a user's knee is placed near one end of the straight edge, while the user places his or her hand further along the length of the straight edge to steady the straight edge. However, the placing of a hand on the plane of the elongated planar straight edge does not always provide sufficient pressure to hold the straight edge in place. Further, the user's hand which is holding the straight edge is subject to being easily cut as the blade, which is held in the opposite hand, is drawn with substantial force along the straight edge.

SUMMARY OF THE PRESENT INVENTION

The present invention provides an elongated planar member which is positioned against a material to be cut, such as a flooring material. The elongated planar member has an outrigger which provides further friction and further ability to securely hold the device in position. A handle is elevated above the elongated planar member. The handle provides a means to firmly hold one end of the elongated planar member in place, while the other end of the elongated planar member is held in place by the user's knee.

DESCRIPTION OF THE DRAWINGS

FIG. 7 is a top plan view of a second embodiment of the device.

FIG. 8 is a side elevation of the second embodiment of the device.

FIG. 9 is a front elevation of the second embodiment of the device.

FIG. 10 is a rear elevation of the second embodiment of the device.

FIG. 11 is a side elevation of the second embodiment of the device.

DESCRIPTION OF THE PREFERRED EMBODIMENT

Figure 2:
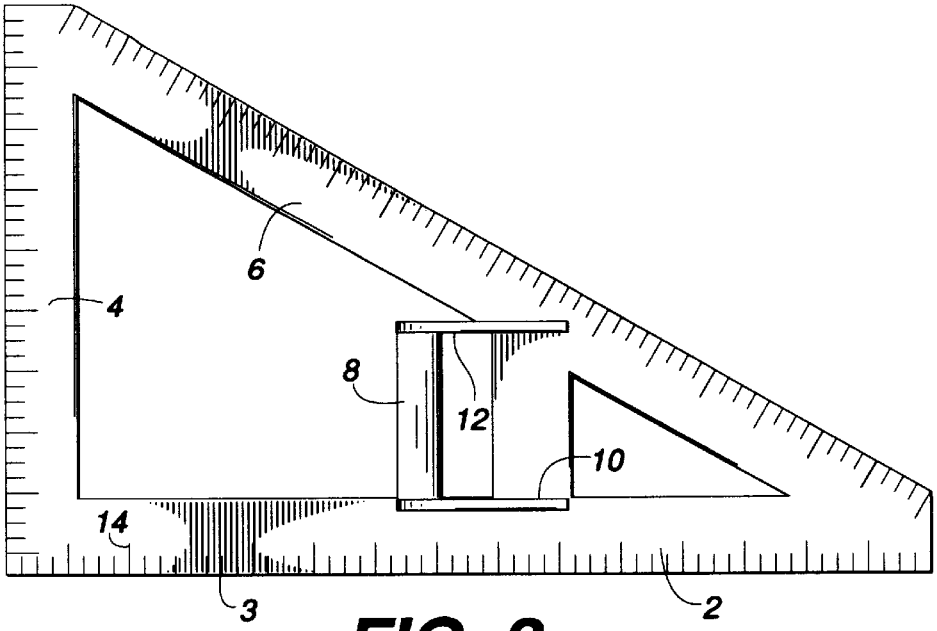
FIG. 2 is a top, plan view of a first embodiment of the device.
Figure 3:
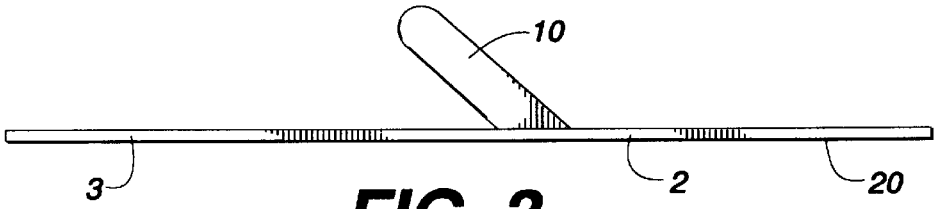
FIG. 3 is a side elevation of the first embodiment of the device.
Figure 4:
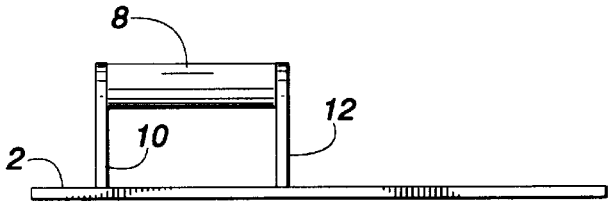
FIG. 4 is a frontal view of the first embodiment of the device.
Figure 5:
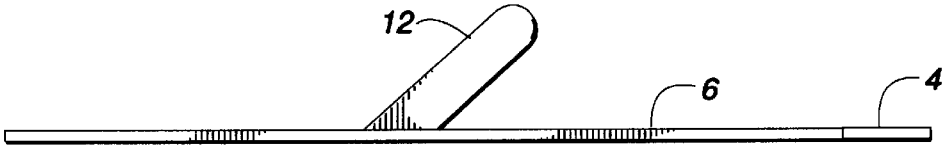
FIG. 5 is a side elevation of the first embodiment of the device.
Figure 6:
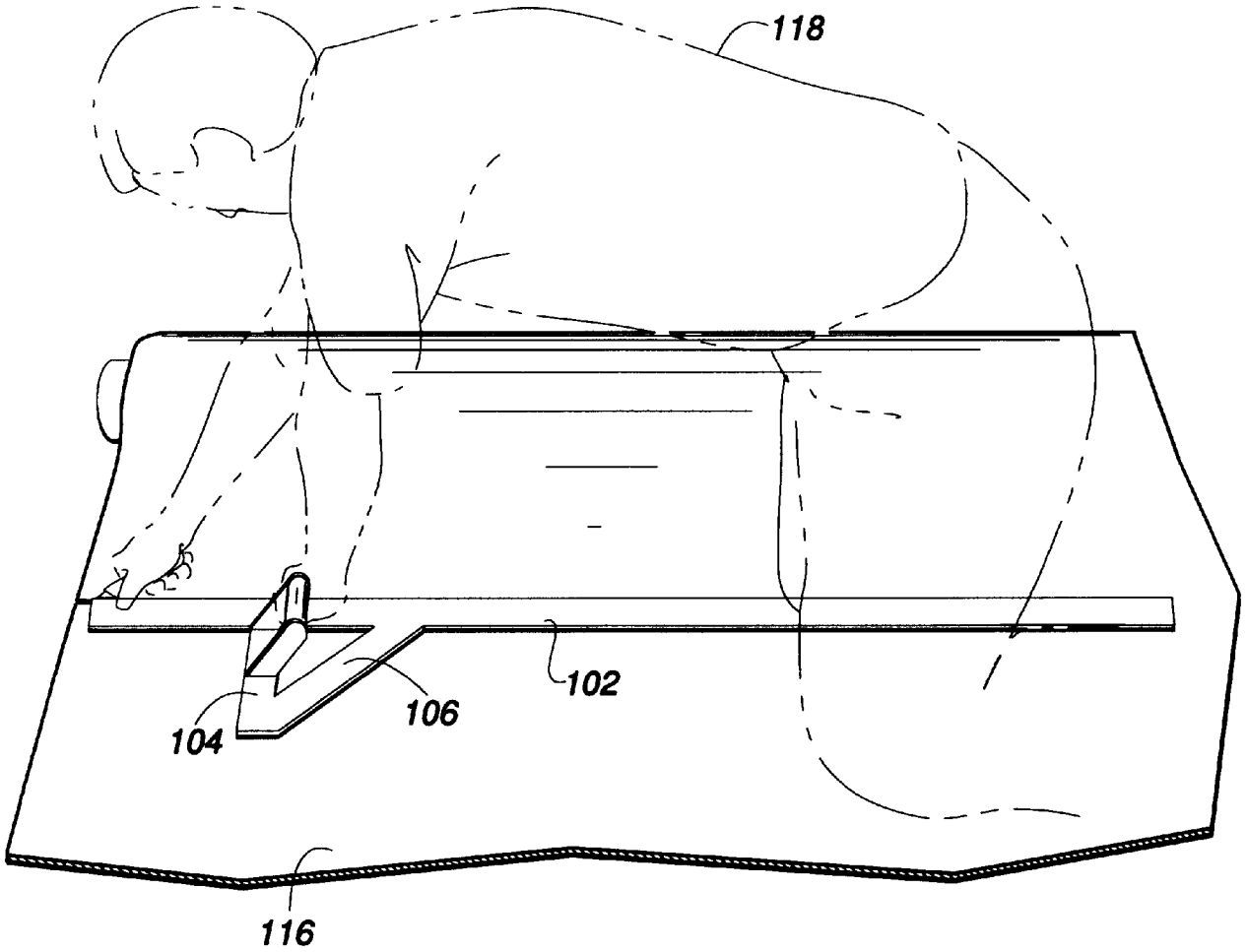
FIG. 6 is a perspective view of the device positioned over the flooring material to be cut.

Referring now to the drawing figures, FIG. 2 shows a top plan view of a first embodiment of the device. An elongated planar member 2 forms one side of the device. The elongated planar member has a relatively long straight edge 3 against which a cutting blade may be maneuvered to cut and shape a material which is formed in sheets, such as floor covering. An outrigger 4 extends from the first elongated planar member. As shown in this embodiment, one end of the outrigger extends from, and is joined with, the elongated planar member. The outrigger is shown as joining the elongated planar member at a right angle.

In the embodiment shown in FIGS. 1 through 5, a second elongated member 6 is connected to the outrigger and to the first elongated planar member. One end of the second elongated member joins with one end of the outrigger, and the opposite end of the second elongated member joins with an end of the first elongated planar member, so that the first elongated planar member, the second elongated member and outrigger form a guide which is triangular in shape.

As shown in FIG. 2, a second outrigger extends from the first planar elongated member. One end of the second outrigger which is parallel to the first outrigger, and is located near handle 8 joins with the first elongated planar member, while the opposite end of the second outrigger joins the second elongated member.

An elevated handle 8 is provided for the device. The handle should extend sufficiently above the first planar member to remove a user's hand from exposure to the cutting blade as the blade traverses the straight edge of the first elongated planar member. It is preferred that the grip of the handle extend above, but generally perpendicular to, the length of the first elongated member for most effective positioning and control of the guide.

Figure 1:
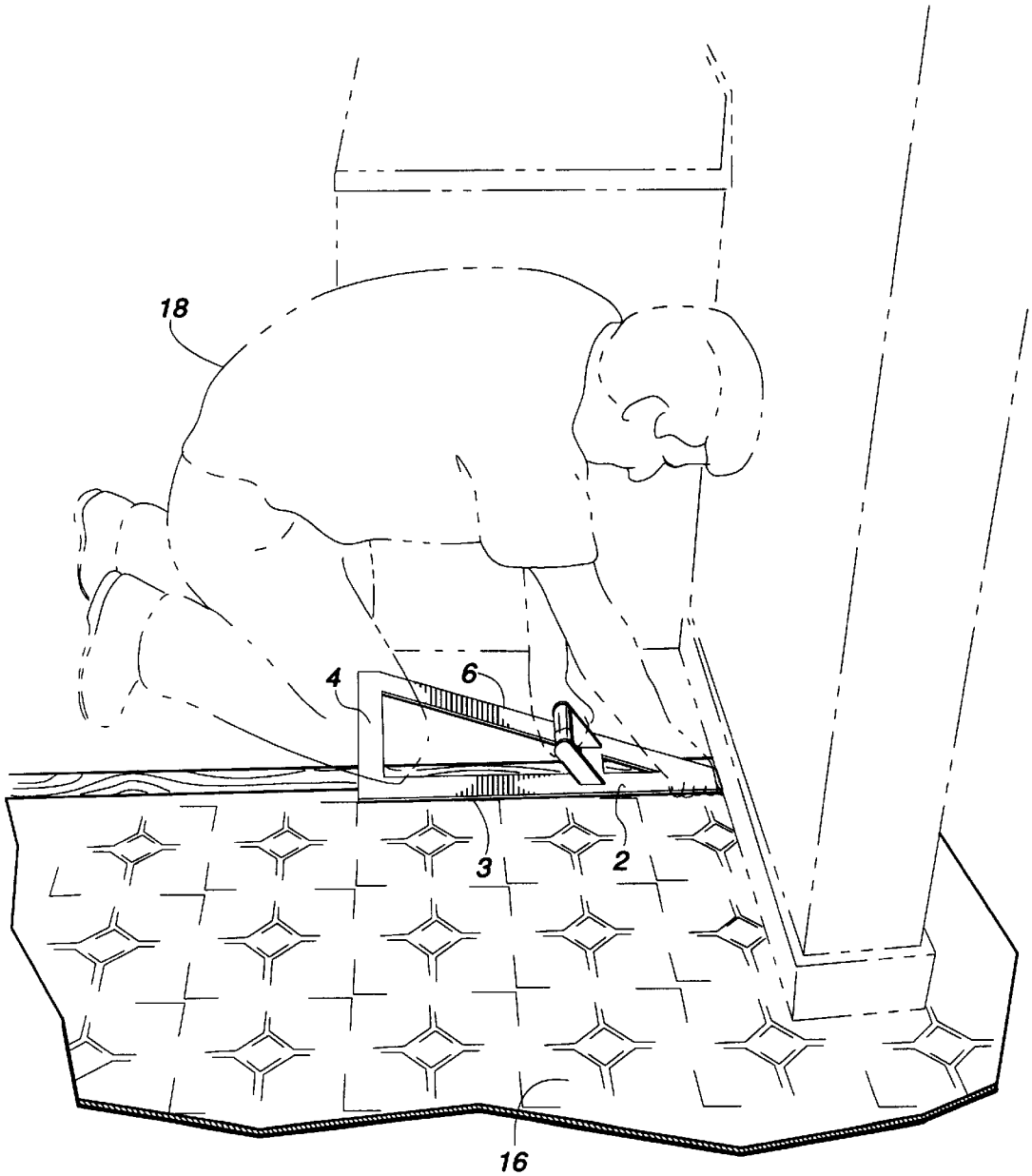
FIG. 1 is a perspective view of the device positioned over flooring material which is to be cut.

As shown, the handle is comprised of generally parallel risers, with one riser 10 connected to the first elongated planar member, and the remaining riser 12 connected to the second elongated member. The second elongated member may serve as an outrigger. A grip is contained between the risers. The angle of the risers aids in transferring pressure applied by the user's hand to one end of the first elongated planar member, while the user's knee will be positioned over a more rearward portion of the first elongated planar member, as shown in FIG. 1. Scale markings 14 may be provided on various portions of the guide as desired.

In use, a material which is formed in a sheet, such as floor covering, is positioned. The material may then be cut by a user, as demonstrated in FIG. 1, by positioning the guide over the flooring material 16, with the straight edge of the first elongated planar member along a line to be cut. A right-handed user 18 places a right knee on a rearward end of the guide, usually over, or on, a rearward portion of the first elongated planar member. However, the right knee could be positioned over the outrigger, and the outrigger is provided for this purpose. The opposite end of the guide, and therefore, the straight edge, is positively positioned and secured by the user's placing his or her hand on the grip of the handle. In the kneeling position, the user's body weight, transmitted through the hand and into the handle, will provide adequate force, in combination with the presence of the user's knee on the other end of the device, to firmly secure the device in place. It can be seen in FIG. 1 that the angle of the handle risers transfers the user's weight toward the front of the device where it is needed. The user then traverses a blade across the material to be cut in the usual fashion to cut the material.

The device may be formed for use by a right-handed user or a left-handed user. To form the device for a left-handed user, the handle may be repositioned to appear on what would be the underside of the device shown in FIG. 3. It is assumed that a left-handed user will hold the blade in the left hand, and will hold the guide device with his or her right hand and left knee.

In addition to the requirement of a straight edge, the first elongated member must have a relatively flat bottom which will uniformly contact the sheet of material to be cut. The bottom surface 20, or plane, could, at places, rise away from the material to be cut, but there must be sufficient contact with the material to provide friction to hold the device securely in place. The outrigger must also have a bottom surface which is generally in the same plane as the first elongated planar member, so that the guide lies flat against the floor. The bottom surface of the outrigger provides additional frictional contact with the floor.

A second embodiment of the device is shown in FIGS. 6 through 11. Referring now to FIG. 7, the second embodiment has a first elongated planar member 102, a second elongated member 106 and an outrigger 104. As shown, the first elongated planar member, second elongated member and outrigger form a triangle, however, each end of the first elongated member extends past the outrigger and the second elongated member.

The requirements of the first elongated planar member embodiment are like the requirements of the first elongated planar member of the first embodiment. A straight edge is provided against which a blade is traversed to cut a sheet of material 116. Scale markings 114 may be provided if desired.

A handle 108 is provided. The handle is elevated to reduce the danger of a user's hand being cut as the blade traverses against the first elongated planar member. The handle, as shown, is positioned to provide a force to hold the guide in place at one end, while a user's knee will be positioned at or near a rearward portion of the first elongated planar member to hold the device in place. It is preferred that the device have risers 110,112 which are angled to transfer the force of the user 118 in the position shown in FIG. 6 through the handle of the device to hold one end in place, while the weight of the user transferred through the knee in the kneeling position will hold the opposite end of the device in place. As show, the handle is attached with one riser extending from the outrigger. The remaining riser is attached near a point where the outrigger joins the first elongated planar member. An optional second elongated member connects an end of the outrigger with the first elongated member.

What is claimed is:

1. A straight edge guide for cutting flooring materials, comprising:

a. a first elongated member having a front end and a rearward end and a straight edge extending between the front end and the rearward end;

b. a second elongated member having a front end and a rearward end, said front end of said second elongated member extending outwardly from a side of said first elongated member which is opposite said straight edge, wherein said first and second elongated members form a guide;

c. a first riser attached to said first elongated member at a location proximate said front end of said first elongated member, said first riser extending upwardly and rearwardly from said first elongated member;

d. a second riser attached to said second elongated member at a location proximate said front end of said second elongated member, said second riser extending upwardly from said second elongated member and also extending substantially parallel to said first riser; and e. a handle attached to upper portions of said first riser and said second riser, said handle being positioned above said first and second elongated members.

* * * * *

UNITED STATES PATENT AND TRADEMARK OFFICE

CERTIFICATE OF CORRECTION

PATENT NO. : 6,018,880
DATED : February 1, 2000
INVENTOR(S) : Wiggins

It is certified that error appears in the above-identified patent and that said Letters Patent is hereby corrected as shown below:

Title page,
[*] delete "602" and insert -- 0 --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*